US009834741B1

(12) United States Patent
Berry et al.

(10) Patent No.: US 9,834,741 B1
(45) Date of Patent: Dec. 5, 2017

(54) ALL-PURPOSE DEGREASER

(71) Applicants: William Berry, Miami, FL (US); Anthony Corbitt, Miami, FL (US)

(72) Inventors: William Berry, Miami, FL (US); Anthony Corbitt, Miami, FL (US)

( * ) Notice: Subject to any disclaimer, the term of this patent is extended or adjusted under 35 U.S.C. 154(b) by 0 days.

(21) Appl. No.: 15/253,722

(22) Filed: Aug. 31, 2016

(51) Int. Cl.

| | |
|---|---|
| ***C11D 1/72*** | (2006.01) |
| ***C11D 7/16*** | (2006.01) |
| ***C11D 9/14*** | (2006.01) |
| ***C11D 9/34*** | (2006.01) |
| ***C11D 3/04*** | (2006.01) |
| ***C11D 3/065*** | (2006.01) |
| ***C11D 3/20*** | (2006.01) |
| ***C11D 3/18*** | (2006.01) |
| ***C11D 3/08*** | (2006.01) |
| ***C11D 1/22*** | (2006.01) |

(52) U.S. Cl.
CPC ..... *C11D 3/044* (2013.01); *C11D 1/22* (2013.01); *C11D 3/065* (2013.01); *C11D 3/08* (2013.01); *C11D 3/188* (2013.01); *C11D 3/2068* (2013.01)

(58) Field of Classification Search
CPC ..... C11D 1/72; C11D 3/0057; C11D 3/1246; C11D 3/1226; C11D 3/2037; C11D 3/3418; C11D 7/16; C11D 7/263; C11D 9/14; C11D 9/34; C11D 11/0023
See application file for complete search history.

(56) References Cited

U.S. PATENT DOCUMENTS

| | | | | | |
|---|---|---|---|---|---|
| 4,256,601 | A * | 3/1981 | Sobata | C11D 1/72 | 510/108 |
| 4,421,680 | A * | 12/1983 | Shivar | C11D 1/22 | 510/186 |
| 4,756,846 | A * | 7/1988 | Matsuura | C11D 3/02 | 134/40 |
| 5,158,710 | A * | 10/1992 | VanEenam | C11D 17/0021 | 510/174 |
| 5,935,919 | A * | 8/1999 | Shinomiya | C11D 11/0035 | 510/220 |
| 6,156,716 | A * | 12/2000 | Ahmed | C11D 3/10 | 510/197 |
| 6,328,816 | B1 * | 12/2001 | Carlson | C11D 1/004 | 134/2 |
| 2004/0198624 | A1 * | 10/2004 | Joye | C11D 1/72 | 510/245 |
| 2012/0115766 | A1 * | 5/2012 | Nojima | C23G 1/14 | 510/272 |
| 2015/0203791 | A1 * | 7/2015 | Peitersen | C11D 3/0073 | 510/197 |

* cited by examiner

*Primary Examiner* — Charles Boyer
(74) *Attorney, Agent, or Firm* — Christopher J VanDam, PA; Chris Vandam

(57) ABSTRACT

An all-purpose cleaning composition comprised of by percentage weight: 1-3% Tetrapotassium Pyrophosphate, 1-3% Sodium Hexametaphosphate FG Fine, 7-10% Sodium Metasilicate Pentahydrate, 7-10% Trisodium Phosphate, 8-10% Sodium TriPolyPhosphate, 8-10% Caustic Soda, 9-11% Nonylphenol ethoxylate, 7-9% Glycol Ether, 1-3% D-Limonene, 3-5% Sodium Xylene Sulfonate and the balance of 43-50% water.

2 Claims, 1 Drawing Sheet

| Ingredient | Percent by weight |
|---|---|
| Tetrapotassium Pyrophosphate | 1-3 |
| Sodium Hexametaphosphate FG Fine | 1-3 |
| Sodium Metasilicate Pentahydrate | 7-10 |
| Trisodium Phosphate | 7-10 |
| Sodium TriPolyPhosphate | 8-10 |
| Caustic Soda Beads | 8-10 |
| Nonylphenol ethoxylate | 9-11 |
| Glycol Ether | 7-9 |
| D-Limonene | 1-3 |
| Sodium Xylene Sulfonate | 3-5 |
| Water | 43-50 |

ALL-PURPOSE DEGREASER

BACKGROUND OF THE INVENTION

1. Field of the Invention

The present invention relates to cleaning solutions, and more particularly, to a water based all-purpose degreaser.

2. Description of the Related Art

Several compositions for cleaning solutions have been designed in the past. None of them, however, includes 1-3% Tetrapotassium Pyrophosphate, 1-3% Sodium Hexametaphosphate FG Fine, 7-10% Sodium Metasilicate Pentahydrate, 7-10% Trisodium Phosphate, 8-10% Sodium TriPolyPhosphate, 8-10% Caustic Soda, 9-11% Nonylphenol ethoxylate, 7-9% Glycol Ether, 1-3% D-Limonene, 3-5% Sodium Xylene Sulfonate and the balance of 43-50% water, each by weight.

Other patents describing the closest subject matter and commercially available formulas provide for a number of more or less complicated features that fail to solve the problem in an efficient and economical way. None of these patents suggest the novel features of the present invention.

SUMMARY OF THE INVENTION

It is one of the main objects of the present invention to provide a highly effective all-purpose cleaner and degreaser.

It is another object of this invention to provide a safe and pleasant to use all-purpose cleaner and degreaser.

It is still another object of the present invention to provide a stable and user-friendly all-purpose cleaner and degreaser.

It is yet another object of this invention to provide such a composition that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 shows a table with ingredient percentage range by weight.

DETAILED DESCRIPTION OF THE PREFERRED EMBODIMENT

Referring now to the drawings, where the present invention is generally observed that it basically includes, by percentage weight: 1-3% Tetrapotassium Pyrophosphate, 1-3% Sodium Hexametaphosphate FG Fine, 7-10% Sodium Metasilicate Pentahydrate, 7-10% Trisodium Phosphate, 8-10% Sodium TriPolyPhosphate, 8-10% Caustic Soda, 9-11% Nonylphenol ethoxylate, 7-9% Glycol Ether, 1-3% D-Limonene, 3-5% Sodium Xylene Sulfonate and the balance of 43-50% water.

The constituent components of the composition are first calculated from the ratios found in the table in FIG. 1. The components are generally stored at a safe room temperature. A suitable container that is resistant to all parts is selected. For example, a high density polyethelene drum can be used as they have a top and a threaded adapter for a spigot or transferring once the mixture is made.

First, 1-3% Tetrapotassium Pyrophosphate is added to the mixing vessel. Then, 1-3% Sodium Hexametaphosphate is added. FG Fine variety has been found to be suitable. The contents are then mixed to combine thoroughly. Next, Sodium Metasilicate Pentahydrate is carefully added and mixed into composition. Then, 7-10% Trisodium Phosphate is added and stirred to combine. Next, 8-10% Sodium TriPolyPhosphate is added and incorporated into the vessel. Then, 8-10% Caustic Soda is slowly added and agitated to fully incorporate into the mixture. Next, 9-11% Nonylphenol ethoxylate is added and mixed to combine. Then 7-9% Glycol Ether and 1-3% D-Limonene are added and stirred to unify the composition. Next, 3-5% Sodium Xylene Sulfonate is added and incorporated. Finally, the balance of 43-50% water is added to bring the batch to the predetermined final weight of the composition. The combination is thoroughly blended to result in a homogeneous product.

Some of the constituent components are sold or marketed under brand names. Examples have been provided in the discussion of the various parts, below. Some commercially available components are supplied with other ingredients and are therefore not in a pure form. Generally, the listed by-weight ingredients in the present composition are calculated based on the weight as provided when distributed under industry standard concentrations.

Tetrapotassium pyrophosphate (TKPP) is in the form of colourless or white crystals, or a white crystalline or granular powder. It is a hydroscopic solid, soluble in water, insoluble in ethanol. TKPP has a higher solubility in water treatment formulations than sodium derivatives.

TKPP is a soap and detergent builder. It is a water softener and an emulsifier to suspend oils and prevent them from redepositing on clothing in the wash. As a water softener, it combines with magnesium to sequester it from the detergent, without precipitating it onto the clothing. As a detergent additive, it can also "reactivate" detergents or soaps that have combined with calcium to make an insoluble scum. Because of the eutrophication of water it is seldom used as a detergent additive.

Sodium hexametaphosphate (SHMP) (Na6P6O18) is a hexamer of composition (NaPO3)6. It is water soluable and odorless. It is typically available as a white crystalline powder. Sodium hexametaphosphate used commercially is typically a mixture of polymeric metaphosphates, of which the hexamer is one, and is usually the compound referred to by this name. From some sources it may be more correctly termed sodium polymetaphosphate.

SHMP is used as a sequestrant and has applications within a wide variety of industries, including primarily as a food additive. SHMP is sometimes included in products used for water softening and detergents.

Another use for sodium hexametaphosphate is as a deflocculant in the production of clay-based ceramic particles. It is also used as a dispersing agent to break down clay and other soil types.

Sodium silicate is the common name for compounds with the formula Na2(SiO2)nO. A well-known member of this series is sodium metasilicate, Na2SiO3. Also known as waterglass or liquid glass, these materials are available in aqueous solution and in solid form. The pure compositions are colourless or white, but commercial samples are often greenish or blue owing to the presence of iron-containing impurities.

They are used in cements, passive fire protection, textile and lumber processing, refractories, and automobiles.

Anhydrous sodium silicate contains a chain polymeric anion composed of corner-shared {SiO4} tetrahedral, and not a discrete SiO32-ion. In addition to the anhydrous form, there are hydrates with the formula Na2SiO3-nH2O (where n=5, 6, 8, 9) which contain the discrete, approximately tetrahedral anion SiO2(OH)2 with water of hydration. For example, the commercially available sodium silicate pentahydrate Na2SiO3-5H2O is formulated as Na2SiO2(OH)2-4H2O and the nonahydrate Na2SiO3-9H2O is formulated as Na2SiO2(OH)2-8H2O. In industry, the various grades of sodium silicate are characterized by their SiO2:Na2O weight ratio (weight ratios can be converted to molar ratios by multiplication with 1.032), which can vary between 2:1 and 3.75:1. Grades with this ratio below 2.85:1 are termed alkaline. Those with a higher SiO2:Na2O ratio are described as neutral.

Sodium silicate is a white powder that is readily soluble in water, producing an alkaline solution. It is one of a number of related compounds which include sodium orthosilicate, Na4SiO4, sodium pyrosilicate, Na6Si2O7, and others. All are glassy, colourless, and soluble in water.

Sodium silicate is stable in neutral and alkaline solutions. In acidic solutions, the silicate ion reacts with hydrogen ions to form silicic acid, which when heated and roasted forms silica gel, a hard, glassy substance.

Trisodium phosphate (TSP) is the inorganic compound with the chemical formula Na3PO4. It is a white, granular or crystalline solid, highly soluble in water producing an alkaline solution. TSPs are used as cleaning agents, lubricants, food additives, stain removers and degreasers.

As commercially available, it is often partially hydrated and may range from anhydrous Na3PO4, to the dodecahydrate, Na3PO4-12H2O. Most often found in white powder form, it can also be called trisodium orthophosphate or simply sodium phosphate.

Trisodium phosphate was at one time extensively used in formulations for a variety of consumer grade soaps and detergents. The most common use for trisodium phosphate has been in cleaning agents.

The pH of a 1% solution is 12 (i.e., very basic), and the solution is sufficiently alkaline to saponify grease and oils. In combination with surfactants, TSP is an excellent agent for cleaning everything from laundry to concrete driveways. This versatility and low manufacturing price made TSP the basis for a plethora of cleaning products sold in the mid-20th century. TSP is still sold and used as a cleaning agent but since the late 1960s its use has diminished in the United States and many other parts of the world. Substitutes are generally not as effective.

TSP is commonly used after cleaning a surface with mineral spirits in order to remove hydrocarbon residues and may be used with household chlorine bleach in the same solution without hazardous reactions. This mixture is particularly effective for removing mildew, but is less effective at removing mold.

Although it is still the active ingredient in some toilet bowl cleaning tablets, TSP is generally not recommended for cleaning bathrooms because it can stain metal fixtures and can damage grout Products sold as TSP substitute, containing soda ash and zeolites, are promoted as a direct substitute. However, sodium carbonate is not as strongly basic as trisodium phosphate, making it less effective in demanding applications. Zeolites are added to laundry detergents as bulking agents that rapidly break down in water and are essentially nonpolluting. Cleaning products labeled as TSP may contain other ingredients, with perhaps less than 50% trisodium phosphate.

Sodium triphosphate (STP), also sodium tripolyphosphate (STPP), or tripolyphosphate (TPP) is an inorganic compound with formula Na5P3O10. It is the sodium salt of the polyphosphate penta-anion, which is the conjugate base of triphosphoric acid. It is produced on a large scale as a component of many domestic and industrial products, especially detergents.

Sodium tripolyphosphate is produced by heating a stoichiometric mixture of disodium phosphate, Na2HPO4, and monosodium phosphate, NaH2PO4, under carefully controlled conditions.

$$2Na_2HPO_4+NaH_2PO_4 \rightarrow Na_5P_3O_{10}+2H_2O$$

STPP is a colourless salt, which exists both in anhydrous form and as the hexahydrate. The anion can be described as the pentanionic chain [O3POP(O)2OPO3]5. Many related di-, tri-, and polyphosphates are known including the cyclic triphosphate [P3O9]3. It binds strongly to metal cations as both a bidentate and tridentate chelating agent.

The majority of STPP is consumed as a component of commercial detergents. It serves as a builder, also known in the industry as a water softener. In hard water (water that contains high concentrations of Mg2+ and Ca2+), detergents are deactivated. Because it is a highly charged chelating agent, [TPP]5 binds to dications tightly and prevents them from interfering with a sulfonate detergent.

Sodium hydroxide (NaOH), also known as lye and caustic soda, is an inorganic compound. It is a white solid and highly caustic metallic base and alkali of sodium which is available in pellets, flakes, granules, beads and as prepared solutions at a number of different concentrations. Sodium hydroxide forms an approximately 50% (by weight) saturated solution with water.

Sodium hydroxide is soluble in water, ethanol, and methanol. This alkali is deliquescent and readily absorbs moisture and carbon dioxide in air.

Sodium hydroxide is used in many industries, mostly as a strong chemical base in the manufacture of pulp and paper, textiles, drinking water, soaps and detergents and as a drain cleaner. Sodium hydroxide is used in many scenarios where it is desirable to increase the alkalinity of a mixture, or to neutralize acids.

Pure sodium hydroxide is a whitish solid, sold in pellets, flakes, beads and granular form, as well as in solution. It is highly soluble in water, with a lower solubility in ethanol and methanol, but is insoluble in ether and other non-polar solvents.

Similar to the hydration of sulfuric acid, dissolution of solid sodium hydroxide in water is a highly exothermic reaction in which a large amount of heat is liberated. The resulting solution is usually colorless and odorless. As with other alkaline solutions, it feels slippery when it comes in contact with skin.

Sodium hydroxide is industrially produced as a 50% solution by variations of the electrolytic (chlor-alkali) process. Chlorine gas is also produced in this process. Solid sodium hydroxide is obtained from this solution by the evaporation of water. Sodium hydroxide is also produced by combining pure sodium metal with water. The byproducts are hydrogen gas and heat, often resulting in a flame, making this a common demonstration of the reactivity of alkali metals in academic environments; however, it is not commercially viable, as the isolation of sodium metal is typically performed by reduction or electrolysis of sodium compounds including sodium hydroxide.

Nonylphenols are a family of closely related organic compounds called alkylphenols. They are used in manufacturing antioxidants, lubricating oil additives, laundry and dish detergents, emulsifiers, and solubilizers. These compounds are also precursors to the commercially important non-ionic surfactants alkylphenol ethoxylates and nonylphenol ethoxylates, which are used in detergents, paints, pesticides, personal care products, and plastics.

Nonylphenol ethoxylate, is used primarily as a nonionic (having no electric charge in water) surfactant. A surfactant is a substance that lowers the surface tension between two liquids or a liquid and a solid, giving nonylphenol ethoxylate the ability to disperse one form of matter into another. BC Surfactant NP-9 ® is a commonly commercially available industrial and domestic chemical or detergent preparation. This waxy or oily solid may be colorless or carry a slight orange tint. It is chemically unreactive and generally viewed as stable. It is soluble in water and has a very low odor.

Nonylphenol ethoxylate decreases the surface tension of a liquid to assist in the penetration and spreading of another liquid or solid. This is generally considered a wetting agent. It stabilizes the spread of a substance into another substance, especially useful in oil spills to remove large amounts of petroleum from the surface of water or other surface. As an additive, it suspends one liquid into another as an emulsifier. It is used widely in industrial laundry, especially in liquid detergents, and in other industries to control machine deposits and clean equipment. It can also accelerate foam development in compounded products.

Glycol ethers are a group of solvents based on alkyl ethers of ethylene glycol or propylene glycol commonly used in paints and cleaners. These solvents typically have a higher boiling point, together with the favorable solvent properties of lower-molecular weight ethers and alcohols. Ethylene glycol monoethyl ether and glycol esther EB are sometimes used as glycol ethers.

Glycol ethers are either "e-series" or "p-series" glycol ethers, depending on whether they are made from ethylene oxide or propylene oxide, respectively. Typically, e-series glycol ethers are found in pharmaceuticals, sunscreens, cosmetics, inks, dyes and water based paints, while p-series glycol ethers are used in degreasers, cleaners, aerosol paints and adhesives. Both E-series glycol ethers and P-series glycol ethers can be used as intermediates that undergo further chemical reactions, producing glycol diethers and glycol ether acetates. Most glycol ethers are water-soluble, biodegradable and only a few are considered toxic.

Limonene is a colorless liquid hydrocarbon classified as a cyclic terpene. The more common d-isomer possesses a strong smell of oranges. It is used in chemical synthesis as a precursor to carvone and as a renewables-based solvent in cleaning products.

Limonene takes its name from the lemon. The rind of the lemon and other citrus fruits contain considerable amounts of this compound, which contributes to their odor. Limonene is a chiral molecule, and biological sources produce one enantiomer. The principal industrial source, citrus fruit, contains d-limonene ((+)-limonene), which is the (R)-enantiomer. Racemic limonene is known as dipentene. d-Limonene is obtained commercially from citrus fruits through two primary methods: centrifugal separation or steam distillation.

Limonene is a relatively stable terpene and can be distilled without decomposition, although at elevated temperatures it cracks to form isoprene. It oxidizes easily in moist air to produce carveol, carvone, and limonene oxide. With sulfur, it undergoes dehydrogenation to p-cymene.

Limonene occurs naturally as the (R)-enantiomer, but racemizes to dipentene at 300° C. When warmed with mineral acid, limonene isomerizes to the conjugated diene α-terpinene (which can also easily be converted to p-cymene). Evidence for this isomerization includes the formation of Diels-Alder adducts between α-terpinene adducts and maleic anhydride.

It is possible to effect reaction at one of the double bonds selectively. Anhydrous hydrogen chloride reacts preferentially at the disubstituted alkene, whereas epoxidation with mCPBA occurs at the trisubstituted alkene.

Sodium xylene sulfonate is a surfactant found in personal care products, primarily in shampoos, because of its ability to serve as a claritant or wetting agent that helps a formula spread more easily and ensure efficient cleansing. Bellsurf SXS-40 ® is a commercially available source of this hydrotrope.

Hydrotropes are compounds that solubilizes hydrophobic compounds in aqueous solutions. Typically, hydrotropes consist of a hydrophilic part and a hydrophobic part, like surfactants. The hydrophobic part is generally too small to cause spontaneous self-aggregation.

Hydrotropes do not have a critical concentration above which self-aggregation suddenly starts to occur, as found for micelle- and vesicle-forming surfactants. Instead, some hydrotropes aggregate in a step-wise self-aggregation process, gradually increasing aggregation size. However, many hydrotropes do not seem to self-aggregate at all, unless a solubilisate has been added. Hydrotropes are in use industrially. Examples of hydrotropes include sodium p-toluenesulfonate and sodium xylene sulfonate.

This group generally increases in the solubility of a solute by the addition of fairly high concentrations of alkali metal salts of various organic acids. However, the term has been used to designate non-micelle-forming substances, either liquids or solids, organic or inorganic, capable of solubilizing insoluble compounds.

Planarity of the hydrophobic part has been emphasized as an important factor in the mechanism of hydrotropic solubilization. Additives may either increase or decrease the solubility of a solute in a given solvent. These salts that increase solubility are said to 'salt in' the solute and those salts that decrease the solubility 'salt out' the solute. The effect of an additive depends very much on the influence, it has on the structure of water or its ability to compete with the solvent water molecules.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An all-purpose degreaser composition comprised in a mixed liquid form, each by percentage weight, of:

1-3% Tetrapotassium Pyrophosphate;
1-3% Sodium Hexametaphosphate;
7-10% Sodium Metasilicate Pentahydrate;
7-10% Trisodium Phosphate;
8-10% Sodium TriPolyPhosphate;
8-10% Caustic Soda;
9-11% Nonylphenol ethoxylate;
7-9% Glycol Ether;
1-3% D-Limonene;
3-5% Sodium Xylene Sulfonate; and
the balance 43-50% water.

2. The all-purpose degreaser composition in claim 1 prepared by adding the elements sequentially as listed in claim 1.

* * * * *